United States Patent [19]

Kulik et al.

[11] 4,372,838

[45] Feb. 8, 1983

[54] COAL LIQUEFACTION PROCESS

[75] Inventors: Conrad J. Kulik, Newark; Howard E. Lebowitz, Mountain View, both of Calif.

[73] Assignee: Electric Power Research Institute, Inc., Palo Alto, Calif.

[21] Appl. No.: 247,732

[22] Filed: Mar. 26, 1981

[51] Int. Cl.[3] ..... C10G 1/06; C10G 1/00

[52] U.S. Cl. ..... 208/10; 208/8 LE

[58] Field of Search ..... 208/8 LE, 10

[56] References Cited

U.S. PATENT DOCUMENTS

| | | | |
|---|---|---|---|
| 2,572,061 | 10/1951 | Sellers | 208/8 LE |
| 3,575,847 | 4/1971 | Sprow et al. | 208/10 X |
| 4,051,012 | 9/1977 | Plumlee et al. | 208/8 LE |
| 4,054,504 | 10/1977 | Chervenak et al. | 208/10 |
| 4,189,371 | 2/1980 | Maa et al. | 208/8 LE |
| 4,190,518 | 2/1980 | Giannetti et al. | 208/8 |
| 4,297,200 | 10/1981 | Briley | 208/10 |
| 4,303,494 | 12/1981 | Whitehurst et al. | 208/10 X |

FOREIGN PATENT DOCUMENTS

| | | | |
|---|---|---|---|
| 2735257 | 2/1978 | Fed. Rep. of Germany | 208/8 LE |

*Primary Examiner*—Delbert E. Gantz
*Assistant Examiner*—William G. Wright
*Attorney, Agent, or Firm*—William G. Addison

[57] ABSTRACT

A coal conversion process which produces an increased yield of distillable products through an efficient use of hydrogen. Coal is contacted with a liquefaction solvent comprised of a process derived light phase residuum and a process derived distillate under liquefaction conditions to form a coal conversion product effluent. The effluent is admixed with a process derived hydrogenation residuum to supply hydrogen-donors and to cool and stabilize the effluent against regressive reactions. Distillables boiling below about 1000° F. then are separated from the combined stream. A portion of the distillables can be recycled for use as solvent or hydrogenated and then recycled. The remaining residuum is admixed with a deashing solvent and thereafter deashed and fractionated under elevated temperature and pressure conditions. The residuum is separated to form a light phase residuum which is recycled for use as solvent and a heavy phase residuum suitable for further up grading. The heavy phase residuum is admixed with a process derived hydrogenation distillate and introduced into a hydrogenation zone. At least a portion of the heavy phase residuum is hydrogenated to form a hydrogenation distillate having a boiling temperature below about 1000° F. The hydrogenation distillate is recovered as a product and a portion is recycled to provide the process derived hydrogenation distillate that is admixed with heavy phase residuum. The remainder of the hydrogenated heavy phase residuum is recycled as the process derived hydrogenation residuum that is admixed with the liquefaction effluent.

21 Claims, 1 Drawing Figure

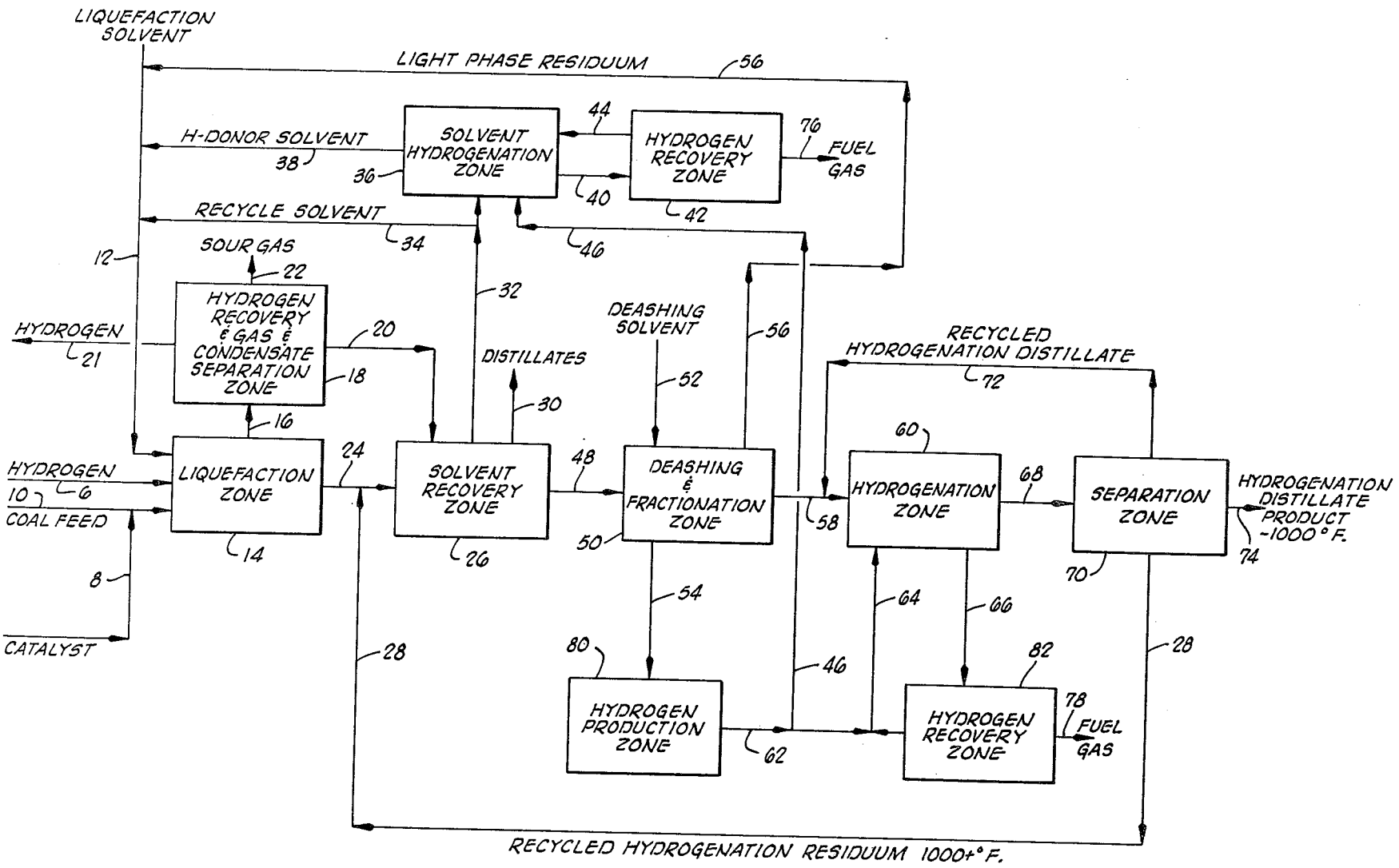
HYDROGENATION DISTILLATE PRODUCT -1000°F.
74
SEPARATION ZONE
70
28
RECYCLED HYDROGENATION DISTILLATE
72
68
HYDROGENATION ZONE
60
66
HYDROGEN RECOVERY ZONE
82
78
FUEL GAS
64
58
46
RECYCLED HYDROGENATION RESIDUUM 1000+°F.
56
DEASHING & FRACTIONATION ZONE
52
DEASHING SOLVENT
54
HYDROGEN PRODUCTION ZONE
80
62
HYDROGEN RECOVERY ZONE
42
76
FUEL GAS
LIGHT PHASE RESIDUUM
44
40
SOLVENT HYDROGENATION ZONE
36
32
DISTILLATES
30
48
50
SOLVENT RECOVERY ZONE
26
34
20
18
24
HYDROGEN RECOVERY & GAS & CONDENSATE SEPARATION ZONE
22
SOUR GAS
16
LIQUEFACTION ZONE
14
H-DONOR SOLVENT
38
RECYCLE SOLVENT
LIQUEFACTION SOLVENT
12
HYDROGEN
21
HYDROGEN
10
6
COAL FEED
8
CATALYST

COAL LIQUEFACTION PROCESS

FIELD OF THE INVENTION

This invention relates to coal liquefaction and more particularly to coal liquefaction employing the recycle of a high molecular weight coal liquefaction solvent. Distillate products are produced which can be substituted for various petroleum derived distillate products or used as a feed stock to various upgrading processes.

DESCRIPTION OF THE PRIOR ART

A number of different processes are being developed for the production of distillable hydrocarbons from coal. In one process, particulate coal is contacted with a hydrogen-containing gas and a hydrogen-donor solvent in a liquefaction reactor at an elevated temperature and pressure. In the liquefaction reactor, the high molecular weight constituents of the coal are cracked and hydrogenated to form lower molecular weight vaporous and distillable products. The effluent from the liquefaction reactor is separated into gases, distillables and a bottoms stream containing nondistillables, unconverted coal and mineral matter. The separation of the effluent normally is made in such a manner as to produce a bottoms stream that has a boiling temperature above about 1000° F. A portion of the distillable product then is catalytically hydrogenated in a solvent hydrogenation unit to replenish the hydrogen-donor constituents contained in the solvent. The hydrogenated product then is recycled to the liquefaction reactor for use as solvent. The bottoms stream is gasified to generate the hydrogen required for the process. Normally, the quantity of bottoms available is greater than the amount necessary to generate the hydrogen required by the process.

Although the described process has many advantages, the limited quantity of distillables produced, the excessive quantity of gases and bottoms formed and the large amount of hydrogen consumed, renders the process somewhat inefficient.

In U.S. Pat. No. 4,189,371 a process is disclosed which overcomes a portion of the problems of the previously described process. In that process, a coal feed is treated with a hydrogen-donor solvent and a hydrogen-containing gas in a first liquefaction zone to produce a first liquefaction effluent. The effluent is separated into a vaporous stream and a liquid stream, the liquid stream consisting of a high molecular weight liquid fraction and a low molecular weight liquid fraction. A portion of the low molecular weight liquid fraction then is separated from the high molecular weight liquid fraction to form a bottoms stream containing less than about 50 weight percent of the low molecular weight liquid fraction. The heavy bottoms stream then is treated with an additional quantity of fresh hydrogen-donor solvent and a hydrogen-containing gas in a second liquefaction zone to form a second liquefaction effluent. The second liquefaction effluent is separated into a vaporous fraction and a liquid fraction. Hydrogenated liquid products then are recovered from the vaporous and liquid fractions.

Although the process outlined above has numerous advantages, undesirable high consumption of hydrogen in the liquefaction zones still occurs. It is desirable to provide a process in which coal can be converted to distillable products in a manner which effects an efficient utilization of hydrogen.

SUMMARY OF THE INVENTION

The present invention provides an improved process for the preparation of distillable products from coal or similar liquefiable carbonaceous solids that at least in part alleviates the problems described above. In accordance with the present invention, it now has been found that an increased yield of hydrogenated liquid products is obtained from bituminous coal, subbituminous coal, lignite or a similar carbonaceous feed material by treating the coal feed with a coal-derived liquefaction solvent comprising a mixture of a separated light phase residuum and either or both a recycled solvent and a hydrogen-donor solvent in a liquefaction zone to produce a liquefaction effluent. A catalyst, if desired, can be used in the liquefaction zone. Hydrogen, optionally, can be added to the liquefaction zone.

The vaporous products are separated from the effluent and the remaining effluent is admixed with a residuum, comprising high molecular weight soluble coal constitutes boiling above 1000° F., remaining from a subsequent hydrogenation step. The mixture is introduced into a liquefaction solvent recovery zone. The distillables boiling up to about 1000° F. are separated from the remaining liquefaction effluent and a portion is recycled for use as liquefaction solvent. A portion of the recycled solvent can be hydrogenated to produce the hydrogen-donor solvent in the liquefaction solvent. The mixture remaining in the liquefaction solvent recovery zone then is introduced into a deashing and fractionation zone to separate the mineral matter, catalyst, if present, and other insolubles from the soluble coal products. The soluble coal products are separated into a light phase residuum and a heavy phase residuum. The liqht phase residuum is recycled as a portion of the liquefaction solvent. The heavy phase residuum is introduced into a hydrogenation zone and admixed with a recycled hydrogenation distillate fraction to reduce the viscosity of the residuum and provide hydrogen-donor constituents. At least a portion of the heavy phase residuum is converted into distillate products having a boiling temperature below about 1000° F. The distillate products are separated and recovered. The 1000+° F. hydrogenation residuum is recycled to admix with the liquefaction effluent to reduce the temperature and viscosity of the effluent and add additional hydrogen donors and other, as yet unidentified, components to facilitate subsequent treatment of the effluent. The recovered distillate products are suitable for use in the place of various petroleum derived distillate products and are capable of being upgraded into a premium distillate product by additional treatment.

BRIEF DESCRIPTION OF THE DRAWING

The single drawing FIGURE schematically illustrates a coal liquefaction process for producing distillate products from coal in accordance with the present invention.

DESCRIPTION OF THE PREFERRED EMBODIMENT

In the process illustrated in the drawing, a coal feed or similar carbonaceous material is introduced into the system through a conduit 10 from a coal storage or feed preparation zone (not shown) and combined with a liquefaction solvent introduced through a conduit 12 within a liquefaction zone 14 to form a slurry. The coal feed employed normally will consist of solid particles of bituminous coal, subbituminous coal, lignite, brown coal or a mixture of two or more of such materials. The coal particulate size may be on the order of from about ¼ inch or larger along the major dimension, but preferably will be crushed and screened to a particulate size of about 8 to 10 mesh or less on the U.S. Sieve Series Scale. It generally is preferred to dry the coal particles to remove the excess water, either by conventional techniques before the solids are mixed with the liquefaction solvent or by mixing the moisture-containing coal particles with hot solvent at a temperature above the boiling point of water, to vaporize the water before liquefaction of the coal.

The initial fluid employed as the coal liquefaction solvent can comprise any of those compounds which have been previously described in the literature and are known by those skilled in the art for use in the liquefaction of coal. However, aromatic hydrocarbons containing hydrogen-donor compounds are preferred. By "hydrogen-donor compounds" it is meant compounds which, under the conditions of reaction herein, can be hydrogenated and subsequently donate hydrogen to coal and other products of a liquefaction reaction in a repetitive manner. For example, compounds such as anthracene, phenanthrene, naphthalene, pyrene, and quinoline and other polycyclic-aromatic and polycyclic-heteroaromatic hydrocarbons comprise acceptable hydrogen donor compounds.

The distillable and nondistillable fractions which subsequently are employed as liquefaction solvent formed during the process described herein are produced in a quantity which can be more than sufficient to replace any liquefaction solvent that is converted to products or which is lost during the process. It will be recognized that as operation of the process continues the liquefaction solvent initially used for start up becomes increasingly diluted with the process-derived liquefaction solvent until the solvent initially used is no longer distinguishable in the process-derived liquefaction solvent. If the process is operated on a semi-continuous basis, the liquefaction solvent which is employed at the beginning of each new period can be that which was obtained from a previous operation.

The liquefaction solvent at equilibrium conditions will include at least a portion of a light phase residuum derived from the process. Preferably, the light phase residuum comprises from about 5 to 100 weight percent of the liquefaction solvent and most preferably from about 5 to 30 weight percent of the liquefaction solvent. The remainder of the liquefaction solvent will comprise distillables having a boiling point temperature range of from about 403° F. to about 1000° F. Optionally, a portion of the distillables can be separately hydrogenated to increase its hydrogen-donor capability, however, this separate hydrogenation of distillates is not preferred. If hydrogenation is employed, it should be controlled to partially saturate the polynuclear hydrocarbons in the distillate while minimizing hydrocracking and total ring saturation. The liquefaction solvent should be blended from the light phase residuum, recycle solvent and hydrogen-donor solvent such that it has a potentially donatable hydrogen content equal to about 0.5 to 8 weight percent of the moisture free coal feed.

The liquefaction zone 14 can comprise apparatus such as a mixer, slurry preheaters and liquefaction reactor (none shown). A catalyst, if desired, can be introduced into liquefaction zone 14 through a conduit 8. The coal liquefaction solvent introduced through conduit 12 is admixed with the coal feed in liquefaction zone 14 in a ratio by weight of from about 1:1 to about 10:1 to form a slurry. Preferably, the liquefaction solvent and coal feed are admixed in a mixer in a ratio by weight of from about 1:1 to 2:1. The slurry then is introduced into the slurry preheater wherein the slurry is heated by heat exchange to a desired temperature, such that when added to the reactor, the desired reaction temperature is maintained. Gaseous hydrogen is added through conduit 6 to the slurry in the preheaters. If is preferred that the amount of hydrogen added to the slurry while within liquefaction zone 14 be minimized so as to reduce capital and operating costs.

The slurry is heated within the preheater to a temperature of about 700°–900° F. The heated slurry then is introduced into the liquefaction reactor which can comprise a quasi-isothermal reactor. The residence time of the slurry within the liquefaction reactor can be from about one minute to over 60 minutes. In the preferred embodiment the residence time, temperature, and hydrogen pressure, are chosen to minimize the preasphaltene content of the liquefaction effluent.

The operating pressure of liquefaction zone 14 is such as to prevent excessive vaporization of the liquefaction solvent and liquefaction products within the preheater and liquefaction reactor. The pressure level can be from about 500 psig. to about 5000 psig. In certain instances it may be necessary to maintain the pressure level above that necessary to prevent excess vaporization to enhance the liquefaction of the coal and hydrogen-donor transfer capability of the liquefaction solvent. For economic reasons, it is preferred that the operating pressure be maintained as low as possible and normally the pressure level will be less than about 2000 psig.

Within liquefaction zone 14, the high molecular weight constituents of the coal are cracked and hydrogenated to form lower molecular weight gases and liquids. The liquefaction solvent gives up the donatable hydrogen which then reacts with the organic radicals liberated from the coal to prevent their recombination. The particular process conditions within the liquefaction zone are selected to insure generation of a product containing a minimal content of preasphaltenes.

After the liquefaction of the coal in the slurry, the gaseous and liquid products are separated. Preferably, the gaseous products which can comprise hydrogen, carbon monoxide, carbon dioxide, ammonia, hydrogen sulfide, methane, ethane, ethylene, propane and the like are separated from the liquid products while still at an elevated pressure. The gaseous products are withdrawn from liquefaction zone 14 through a conduit 16 and introduced into a hydrogen recovery and gas and condensate separation zone 18. The gaseous products are treated within zone 18 to separate any fixed gases and any gaseous condensable liquids from the hydrogen. The recovered hydrogen is recycled back to the liquefaction zone 14 through conduit 21. The remaining fixed gaseous products which include sulfur containing compounds, such as hydrogen sulfide, are withdrawn from zone 18 through a conduit 22 for introduction into sour gas treatment apparatus (not shown). The condensed liquids are withdrawn from zone 18 through a conduit 20 and introduced into a solvent recovery zone 26.

The degassed slurry from liquefaction zone 14 normally will contain solids in the form of unconverted coal, mineral matter, and catalyst, if present, and distillable and substantially nondistillable soluble coal products. The slurry products still are at an elevated temperature and pressure and capable of reaction through repolymerization and other regressive reactions. Preferably, the slurry is maintained at the elevated temperature at which liquefaction occurs for only the minimum time necessary to effect the liquefaction reaction. The slurry is withdrawn from liquefaction zone 14 through a conduit 24 and admixed with the residuum from a subsequent hydrogenation reaction comprising hydrogenated coal constituents having a boiling temperature above about 1000° F. introduced through a conduit 28. The addition of this hydrogenation residuum to the withdrawn liquid products stream increases the concentration of available hydrogen-donor compounds by addition of particularly active donor species and reduces the temperature of the liquid products which in combination substantially reduce the rate of any regressive reactions. Preferably, the hydrogenation residuum comprises a catalytic hydrogenation vacuum residuum having a nominal boiling temperature above about 1000° F.

In solvent recovery zone 26, the mixture is flashed to a reduced pressure level to separate any distillables having a boiling temperature below about 1000° F. Preferably, the liquefaction liquid products are not subjected to additional heating within solvent recovery zone 26, such as occurs when a reboiler is used in conjunction with vacuum distillation, to minimize degradation of the liquid products.

In the event the temperature and pressure level of the mixture of liquid products and hydrogenation residuum in solvent recovery zone 26 is insufficient to permit separation of the distillables boiling below about 1000° F., a lower distillate cut-point is acceptable. In this event, the remaining distillables are separated in subsequent process apparatus.

The flashed distillables boiling below about 1000° F. can be further fractionated within solvent recovery zone 26 to separate the lower boiling temperature distillables from the remainder. Preferably, the distillables having a boiling temperature up to and including that of tetralin or about 403° F. are separated from the remaining distillables having a boiling temperature of from about 403° F. to about 1000° F. The separated lower boiling temperature distillables are withdrawn from solvent recovery zone 26 through a conduit 30 and recovered as a product of the process. The distillables boiling from about 403° F. to about 1000° F. are withdrawn from solvent recovery zone 26 through a conduit 32. A portion of the distillables in conduit 32 can be recycled through conduit 34 for use as a portion of the liquefaction solvent. The remainder of the distillables in conduit 32, if any, can be introduced into a solvent hydrogenation zone 36.

In one embodiment of the invention, the distillables are combined with hydrogen introduced through a conduit 46 into solvent hydrogenation zone 36 and hydrogenated to further increase their donatable hydrogen content. The temperature, pressure and space velocity employed in hydrogenation zone 36 will depend to some extent upon the character of the feed stream employed and the catalyst used, if any. Such selective hydrogenation of polyaromatics is well known by those individuals skilled in the art. In general, temperatures within the range of from about 500° F. to 900° F., pressures from about 750 psig. to about 3000 psig. and space velocities between about 0.3 to 3.0 pounds of feed per hour per pound of catalyst are suitable. It generally is preferred to maintain a hydrogenation temperature of from about 600° F. to about 750° F., a pressure of from about 1200 psig. to 2500 psig. and a liquid hourly space velocity of from 1.0 to 2.5 pounds of feed per hour per pound of catalyst. The hydrogen treat rate can be in the range of from about 5 to 50 standard cubic feet per pound of feed.

Any of a variety of hydrotreating catalysts can be employed in the process. Such catalysts typically comprise an alumina carrying one or more iron group metals and one or more metals from Group VI-B of the Periodic Table in the form of an oxide or sulfide. Representative metal combinations which may be employed in such catalysts include oxides and sulfides of cobalt-molybdenum, nickel-molybdenum-tungsten, cobalt-nickel-molybdenum and the like. The preparation of such catalysts has been described in the literature and is well known in the art. Generally, the active metals are added to the substrate by impregnation from aqueous solution and this is followed by drying and calcining to activate the catalyst. Numerous commercial hydrogenation catalysts are available from various catalyst manufactures and can be used.

The hydrogenation reaction that takes place within solvent hydrogenation zone 36 results in the formation of some gaseous products such as methane, ethane, propane and the like. The gaseous products are separated together with any unreacted hydrogen from the hydrogenated liquids in zone 36 and passed through a conduit 40 into a hydrogen recovery zone 42. The separation can be effected in a gas-liquid separator such as a hydrocyclone or any other suitable apparatus.

In hydrogen recovery zone 42, the hydrogen is separated from the other gaseous reaction products and returned to solvent hydrogenation zone 36 through a conduit 44. The remaining gaseous products are withdrawn from zone 42 through a conduit 76 for use, for example, as a fuel gas.

The hydrogenated liquids are withdrawn from solvent hydrogenation zone 36 through a conduit 38 for use as a hydrogen-donor solvent in the composition comprising the liquefaction solvent.

In an alternate embodiment of the invention, hydrogenation zone 36 is not utilized. In this instance, the reaction severity in the liquefaction zone 14 must be increased.

The residuum remaining in solvent recovery zone 26 comprising substantially nondistillable and some distillable soluble coal products and insoluble coal products comprising unconverted coal, mineral matter (often referred to as ash) and catalyst, if present, together with the hydrogenation residuum and unconverted light phase residuum of the liquefaction solvent is withdrawn through a conduit 48 and introduced into a deashing and fractionation zone 50.

The addition of the hydrogenation residuum to the liquefaction liquid products prior to solvent recovery provides the benefits previously described and also, in combination with the unconverted light phase residuum of the liquefaction solvent, reduces the viscosity of the liquefaction liquid product residuum in solvent recovery zone 26 so that the distillables separable within the described operating parameters in zone 26 can be removed without creating a handling problem with regard to pumpability of the residuum at process temperatures. In addition to reducing the viscosity of the liquefaction liquid product residuum, the unconverted light phase residuum and hydrogenation residuum contain hydrogen-donors and other, as yet unidentified, reactive species which substantially prevent or minimize regressive degradation of the thermally reactive coal liquefaction products during downstream treatment processes. The addition of this hydrogenation residue results in an increased recovery of products in deashing and fraction zone 50, and production of a superior "light phase residuum" for subsequent recycle in the process.

The deashing accomplished in deashing and fractionation zone 50 can be accomplished by, for example, filtration, centrifugation, hydrocyclones, gravity settling or the like. In a preferred embodiment, the residuum is admixed with a deashing solvent introduced into zone 50 through a conduit 52 to form a prepared mixture which then is introduced into a first separation vessel (not shown). Alternatively, the prepared mixture can be formed by contacting the deashed solvent and residuum within the first separation vessel. Sufficient deashing solvent is introduced into zone 50 to provide a ratio by weight of deashing solvent to residuum in the range of from about 1:1 to about 10:1. Larger quantities of deashing solvent can be used, however, such use is uneconomical.

The term "deashing solvent" as used herein refers to those solvents consisting essentially of at least one substance having a critical temperature below 800 degrees F. selected from the group consisting of: aromatic hydrocarbons having a single benzene nucleus and normal boiling points below about 310 degrees F., such as benzene, toluene, o-, m- and p-xylene, ethyl benzene, isopropyl benzene and monocyclic aromatic hydrocarbons in general having normal boiling points below about 310 degrees F.; cycloparaffin hydrocarbons having normal boiling points below about 310 degrees F., such as cyclobutane, cyclopentane, cyclohexane, cycloheptane and nonaromatic monocyclic hydrocarbons in general having normal boiling points below about 310 degrees F.; open chain mono-olefin hydrocarbons having normal boiling points below about 310 degrees F., such as butene, pentene, hexene and heptene; open chain saturated hydrocarbons having normal boiling points below about 310 degrees F., such as pentane, hexane and heptane; mono-, di, and tri-open chain amines containing from about 2–8 carbon atoms, such as ethyl, propyl, butyl, pentyl, hecyl, heptyl, and octyl amines; carbocyclic amines having a monocyclic structure containing from about 6–9 carbon atoms, such as aniline and its alkyl homologs; heterocyclic amines containing from about 5–9 carbon atoms, such as pyridine and its alkyl homologs; and phenols containing from about 6–9 carbon atoms and their homologs.

The prepared mixture is separated within the first separation vessel into a first light phase and a first heavy phase comprising the insoluble coal products and some deashing solvent. The first separation vessel is maintained at a temperature level in the range of from about 400° F. to about 700° F. and a pressure level above about 550 psig. and preferably in the range of from about 550 psig. to about 1500 psig. to effect the separation of the prepared mixture.

The term "insoluble coal products" as used herein means any of the constituents of the prepared mixture that are insoluble in the deashing solvent under the operating conditions of the process. The insoluble coal products can include unconverted coal, mineral matter, catalyst, if present, some soluble coal products generally comprising benzene insolubles and the like.

The first heavy phase is withdrawn from the first separation vessel and flashed to form at least one stream comprising the deashing solvent and one other stream comprising ash concentrate.

The term "ash concentrate" as used herein means a composition of matter comprising primarily unconverted coal, mineral matter, catalyst, if present, and some minor quantity of soluble coal products generally comprising benzene insolubles formed upon flashing the first heavy phase.

The ash concentrate is withdrawn from deashing and fractionation zone 50 through a conduit 54 and introduced into a hydrogen production zone 80. In hydrogen production zone 80 the remaining hydrocarbon content of the ash concentrate is employed to generate hydrogen gas for use in the process. Zone 80 can comprise, for example, a gasifier such as that disclosed in the literature and known by the art as a Koppers-Totzek gasification unit. Alternatively, after appropriate pretreatment of the ash concentrate, a slagging or conventional Lurgi gasification unit can be used to produce hydrogen gas. The hydrogen gas is withdrawn from hydrogen production zone 80 through a conduit 62 for introduction into the hydrogenation apparatus of the present invention.

The first light phase then is withdrawn from the first separation vessel and introduced into a second separation vessel (not shown). If desired, an additional quantity of deashing solvent can be admixed with the first light phase prior to or after entry into the second separation vessel to increase the deashing solvent to residuum ratio. Such additional deashing solvent can improve the subsequent fraction of the residuum depending upon the original coal feed, liquefaction zone conditions and liquefaction solvent. The second separation vessel is maintained at a temperature level above the temperature level of the first separation vessel and preferably in the range of from about 450° F. to about 900° F. and a pressure level substantially the same as in the first separation vessel. Preferably the pressure level is maintained in the range of from about 400 psig. to about 1500 psig.

The particular temperature and pressure conditions in the second separation vessel are selected to provide a differential in the deashing solvent density existing within the first separation vessel and the second separation vessel, sufficiently large to cause the first light phase to separate into a second light phase comprising deashing solvent and a light phase residuum comprising distillable and some substantially nondistillable soluble coal products and a second heavy phase comprising a heavy phase residuum comprising substantially nondistillable soluble coal products and some deashing solvent.

The second light phase is withdrawn from the second separation vessel and introduced into a third separation vessel (not shown). In one embodiment the third separation vessel is maintained at a temperature level above the temperature level existing within the second separation vessel and at substantially the same pressure level as in the second separation vessel to effect a separation of the second light phase. The second light phase is separated into a third light phase comprising the deashing solvent and a third heavy phase comprising the light phase residuum. The light phase residuum is withdrawn from the third separation vessel and passed from deashing fractionation zone 50 through a conduit 56 for recycle to liquefaction zone 14 for use as a portion of the liquefaction solvent.

In an alternate embodiment of the present invention the third separation vessel can comprise a flash vessel (not shown) wherein the second light phase is flashed to a reduced pressure level to form at least one stream comprising deashing solvent and one other stream comprising the light phase residuum. The light phase residuum then is withdrawn from the third separation vessel and passed to liquefaction zone 14 as previously described.

The second heavy phase is withdrawn from the second separation vessel and flashed to produce at least one stream comprising at least a portion of any deashing solvent that is present and one other stream comprising the heavy phase residuum. The heavy phase residuum then is passed from deashing and fractionation zone 50 through a conduit 58 to enter a hydrogenation zone 60. A quantity of a hydrogenation distillate having an average boiling temperature below about 1000° F. is admixed with the heavy phase residuum either within conduit 58 or after introduction into hydrogenation zone 60. The hydrogenated distillate is introduced through a conduit 72. Sufficient hydrogenation distillate is admixed with the heavy phase residuum such that upon hydrogenation of the heavy phase residuum an optimum product yield of a hydrogenation distillate product having a boiling temperature below about 1000° F. is obtained.

In one embodiment of the present invention, hydrogenation zone 60 comprises a multi-stage catalytic hydrogenation zone. The catalysts which are employed in the catalytic hydrogenation zone can be any of those which are known to individuals familiar with the upgrading of heavy residuum such as from petroleum. Preferably, the first stage of the catalytic hydrogenation zone employs an inexpensive catalyst which can be used as a scavenger to remove any impurities which may interfere with hydrogenation of the remaining heavy phase residuum. The second stage of the catalytic hydrogenation zone then employs a second catalyst to convert at least a portion of the remaining heavy phase residuum to distillate products. The operating conditions of the first and second stages of the catalytic hydrogenation zone are within the range of the conditions previously disclosed with regard to solvent hydrogenation zone 36 and such conditions are well know to those individuals skilled in the art. Gaseous hydrogen is introduced into hydrogenation zone 60 through a conduit 64. The hydrogenation reaction results in the production of various gaseous products such as, for example, methane, ethane, propane and the like in addition to the lighter liquid products which are formed. The gaseous products are separated from the liquid products within hydrogenation zone 60 and are withdrawn through a conduit 66 to enter a hydrogen recovery zone 82. The separation can be effected in a gas-liquid separator.

In hydrogen recovery zone 82 unreacted hydrogen gas is separated from the other gaseous products of the hydrogenation reaction and recycled through conduit 64 for us in supplying the gaseous hydrogen necessary for the reaction within hydrogenation zone 60. The remaining gaseous products within hydrogenation zone 82 are withdrawn through a conduit 78 for use, for example, as a fuel gas.

The liquid products within hydrogenation zone 60 are passed through a conduit 68 to enter a separation zone 70. In separation zone 70 the liquid products are separated into a hydrogenation distillate having a boiling temperature of below about 1000° F. and a hydrogenation residuum having a nominal boiling temperature above about 1000° F. At least a portion of the hydrogenation distillate is withdrawn through conduit 72 for recycle to hydrogenation zone 60. The remaining hydrogenation distillate is withdrawn from separation zone 70 through a conduit 74 and recovered as a product of the process of the present invention. The hydrogenation residuum is withdrawn from hydrogenation zone 70 through conduit 28 and recycled to provide the hydrogenation residuum admixed with the liquefaction zone effluent before introduction into solvent recovery zone 26. Separation zone 70 can comprise, for example, a vacuum flash vessel in which the pressure on the hydrogenation products is substantially reduced to vaporize a portion of the hydrogenation products and then the vaporous and remaining liquid products are separated into the respective fractions.

To further illustrate the process of the present invention and not by way of limitation the following examples are provided. All percentages hereinafter referred to in the examples are weight percent unless otherwise indicated.

EXAMPLE I

An Indiana V coal having a typical ultimate analysis comprising 69.22% C, 4.57% H, 1.36% N, 10.68% O, 3.62% S and 10.55% ash, is ground to a particle size of −65 mesh on the Tyler scale. The coal is admixed with a solvent comprising a coal derived 403°–995° F. boiling point temperature fraction to provide a slurry comprising 33.5% coal and 66.5% coal derived solvent. The solvent was generated from an extraneous operation wherein Indiana V coal was liquefied and a fraction was separated from the liquefaction products by distillation. The selected solvent fraction had the following analysis: 86.46% C, 8.98% H, 0.75% N, 3.42% O and 0.39% S. The boiling point composition range of the fraction was as follows: 0.3% 403° F., 6.5% 403°–464° F., 32.4% 464°–532° F., 34.8% 532°–644° F., 24.7% 644°–995° F. and 1.3% +995° F.

The slurry was introduced into a short residence time tubular coal liquefaction reactor having a 0.313 inch I.D. at a flow rate of 30 lbs. per hr. The slurry was heated within the reactor to a maximum temperature of about 829°–838° F. The nominal residence time of the slurry at a temperature above 600° F. within the reactor was about 5 minutes. The operating pressure of the reactor was 500 psig. No gaseous hydrogen was fed with the slurry.

After approximately 2 hours of slurry feeding to the reactor, variations in the discharge pressure of the pump employed to introduce the slurry into the reactor were noted. Approximately 0.3 hours later the tubular reactor plugged causing the slurry feed pump to fail.

EXAMPLE II

The solvent of Example I was topped to remove the 403°–493° F. boiling range components and the 493°–995° F. fraction then was hydrogenated over a commercial catalyst to add donatable hydrogen to the solvent. A slurry of Indiana V coal then was formed as in Example I and fed to the short residence time tubular reactor. The reactor was operated as previously described. After several hours of operation the tubular reactor again plugged causing a failure of the slurry feed pump.

EXAMPLE III

In accordance with the process of the present invention a slurry is formed with the Indiana V coal of Example I with a solvent comprising 70% coal derived recycle solvent having a 493°-995° F. boiling point range and 30% process derived light phase residuum. The light phase residuum had the following analysis before hydrogenation: 86.74% C, 7.04% H, 1.4% N, 3.95% O, 0.78% S and 0.09% ash. The boiling point composition range of the light phase residuum was as follows: 6.5%-878° F., 16.2% 878°-995° F. and 77.3% +995° F. The solvent was catalytically hydrogenated prior to blending with the coal at a temperature of 725° F., a pressure of 1500 psig., a liquid hourly space velocity of 1 lb. of feed per hr. per lb. of catalyst and a hydrogen feed rate of 15 SCF $H_2$ per lb. of feed. The resulting slurry comprises 33.5% coal and 66.5% catalytically hydrogenated coal derived solvent.

The slurry was introduced into the short residence time reactor of Example I at a flow rate of 30 lbs. per hr. The slurry was heated within the reactor to a maximum temperature of about 825° F. The nominal residence time of the slurry at a temperature above 600° F. within the reactor was about 5.4 minutes. The operating pressure of the reactor was 500 psig. No gaseous hydrogen was fed with the slurry. The reactor effluent was vacuum distilled to remove components below 995° F. Those components were further fractionated to recover the 493°-995° F. distillate for use as the coal derived recycle solvent.

The residue boiling above a temperature of 995° F. was admixed with another solvent comprising a hydrocarbon fraction having a boiling point range of from about 150° F. to about 250° F. in a ratio by weight of solvent to residue of about 2 to 1. This mixture was introduced into a first separation vessel which was maintained at a temperature level of about 550° F. and pressure level of about 800 psig. to effect a separation of the residue into a first light phase comprising soluble coal products and a first heavy phase comprising insoluble coal products present in the residue.

The first light phase is withdrawn from the first separation vessel and introduced into a second separation vessel together with an additional quantity of the solvent having the 150°-250° F. boiling point temperature range to provide a ratio by weight of solvent to feed of about 6 to 1. The second separation vessel is maintained at a temperature level of about 660° F. and a pressure level of about 800 psig. to effect a separation of the first light phase into a second light phase comprising the light phase residuum and a second heavy phase comprising a heavy phase residuum comprised of substantially nondistillable soluble coal products. The second light phase is withdrawn from the second separation vessel and flashed to separate the solvent having a 150°-250° F. boiling point temperature range. The light phase residuum then is recycled for admixing with the coal to form the feed slurry. The second heavy phase is withdrawn from the second separation vessel and flashed to separate the solvent having the 150°-250° F. boiling point temperature range and the heavy phase residuum is recovered as a product. Under continued operation in accordance with the process of this invention, the heavy phase residuum would be admixed with a recycled hydrogenation distillate and hydrogenated to form a hydrogenation distillate product having a boiling temperature below 1000° F. and a hydrogenated residual fraction boiling above 1000° F. A portion of the hydrogenated distillate would be used as the said recycled hydrogenation distillate. The hydrogenated residual fraction would be mixed with the product from the coal liquefaction reactor.

After 36 hrs. of continuous reactor operation, introduction of feed to the reactor was voluntarily terminated and a sample of the reactor effluent was collected for analysis. A material balance about the reactor yielded the following products distribution: 70% +995° F. soluble coal components, 1.4% 403°-995° F., 0.8% $C_6$-403° F., 1.1% $C_1$-$C_5$, 1.0% CO and $CO_2$, 1.4% $H_2S$, 4.5% $H_2O$ and $NH_3$ and 19.4% insolubles. The coal conversion achieved within the reactor was found to be 80.6%. The coal conversion is defined as:

$$\% \text{ coal conversion} = [(\text{MF coal} - \text{MF cresol insolubles})/\text{MAF coal}] \times 100$$

The tubular reactor was visually inspected for plugging and substantially no solids build-up was noted.

EXAMPLE IV

In accordance with the process of the present invention a slurry is formed with the Indiana V coal of Example I with a solvent comprising 70% coal derived recycle solvent having a 403°-995° F. boiling point range and 30% process derived light phase residuum. The light phase residuum had the following analysis: 86.82% C, 6.6% H, 1.54% N, 4.09% O, 0.88% S and 0.07% ash. The boiling point composition range of the light phase residuum was as follows: 1.4%-878° F., 14.3% 878°-995° F. and 84.3% +995° F. The resulting slurry comprises 33.5% coal and 66.5% coal derived solvent.

The slurry was introduced into the short residence time reactor of Example I at a flow rate of 30 lbs. per hr. The slurry was heated within the reactor to a maximum temperature of about 825° F. The nominal residence time of the slurry at a temperature above 600° F. within the reactor was about 5.5 minutes. The operating pressure of the reactor was 2000 psig. Gaseous hydrogen was fed with the slurry in an amount of 1.6 SCF $H_2$ per lb. of coal fed. This quantity of hydrogen was calculated to be the amount which was soluble in the slurry at process conditions. The reactor effluent was vacuum distilled to remove components below 995° F. Those components were further fractionated to recover the 493°-995° F. distillate for use as the coal derived recycle solvent.

The residue boiling above a temperature of 995° F. was admixed with another solvent comprising a hydrocarbon fraction having a boiling point range of from about 150° F. to about 250° F. in a ratio by weight of solvent to residue of about 2 to 1. This mixture was introduced into a first separation vessel which was maintained at a temperature level of about 550° F. and pressure level of about 800 psig. to effect a separation of the residue into a first light phase comprising soluble coal products and a first heavy phase comprising insoluble coal products present in the residue.

The first light phase is withdrawn from the first separation vessel and introduced into a second separation vessel together with an additional quantity of the solvent having the 150°-250° F. boiling point temperature range to provide a ratio by weight of solvent to feed of about 6 to 1. The second separation vessel is maintained at a temperature level of about 660° F. and a pressure level of about 800 psig. to effect a separation of the first light phase into a second light phase comprising the light phase residuum and a second heavy phase comprising a heavy phase residuum comprised of substantially nondistillable soluble coal products. The second light phase is withdrawn from the second separation vessel and flashed to separate the solvent having a 150°-250° F. boiling point temperature range. The light phase residuum then is recycled for admixing with the coal to form the feed slurry. The second heavy phase is withdrawn from the second separation vessel and flashed to separate the solvent having the 150°-250° F. boiling point temperature range and the heavy phase residuum is recovered as a product. Under continued operation in accordance with the process of this invention, the heavy phase residuum would be admixed with a recycled hydrogenation distillate and hydrogenated to form a hydrogenation distillate product having a boiling temperature below 1000° F. and a hydrogenated residual fraction boiling above 1000° F. A portion of the hydrogenated distillate would be used as the said recycled hydrogenation distillate. The hydrogenated residual fraction would be mixed with the product from the coal liquefaction reactor.

After 19.5 hrs. of continuous operation, introduction of feed to the reactor was voluntarily terminated and a material balance around the liquefaction and solids separation fractionation unit yielded the following product distribution: 66.3%+995° F. soluble coal components, 6.6% 403°-995° F., 5.1% $C_6$-403° F., 3.0% $C_1$-$C_5$, 1.7% CO and $CO_2$, 1.5% $H_2S$, 5.3% $H_2O$ and $NH_3$ and 12.2% insolubles. The coal conversion (as defined in Example III) achieved within the reactor was found to be 87.8%. The tubular reactor was visually inspected for plugging and no solids build-up was noted.

The results clearly illustrate the benefits which derive from the practice of the present invention. The liquefaction process effluent can be processed to produce hydrogenated liquid products with only a minimum amount of distillable solvent present to provide residuum pumpability through recycle of the hydrogenation residuum. The use of the separated light phase residuum as liquefaction solvent permits efficient use of hydrogen in the process to minimize undesirable gas production.

The phrase "in the substantial absence of gaseous hydrogen" means those instances in which gaseous hydrogen substantially is not present as a separate phase in a mixture of reactants introduced into a liquefaction reactor or other apparatus. This definition includes, for example, instances in which hydrogen gas has been dissolved within a mixture of reactants but is not present in an amount substantially in excess of its solubility in the mixture at the temperature and pressure of the reaction and, therefore, no separate gas phase exists.

While the present invention has been described with respect to what at present are considered to be the preferred embodiments thereof, it is to be understood that changes or modifications can be made in the process or apparatus described without departing from the spirit or scope of the invention as defined by the following claims.

What is claimed is:

1. A process comprising:

contacting a carbonaceous solid with a liquefaction solvent in the presence of gaseous hydrogen under liquefaction conditions in a liquefaction zone to produce a liquefaction effluent comprising a slurry of liquid and solid products;

admixing at least a portion of said liquefaction effluent with a process derived hydrogenation residuum;

separating distillables from said liquefaction effluent and process derived hydrogenation residuum to leave a liquefaction residuum, said distillables having a boiling temperature below about 1000° F.;

treating said liquefaction residuum to separate at least a portion of any solids comprising unconverted coal and mineral matter and form a substantially solids-free residuum;

fractionating said substantially solids-free residuum to form at least a light phase residuum and a heavy phase residuum;

admixing said heavy phase residuum with a process derived hydrogenation distillate to form a mixture, said hydrogenation distillate having a boiling temperature below about 1000° F.;

hydrogenating said mixture of heavy phase residuum and hydrogenation distillate in a hydrogenation zone to convert at least a portion of said heavy phase residuum into a hydrogenation distillate having a boiling temperature below about 1000° F. and leave a hydrogenation residuum;

recycling at least a portion of said hydrogenation distillate to provide said process derived hydrogenation distillate;

recycling at least a portion of said hydrogenation residuum to provide said process derived hydrogenation residuum; and recovering any remaining hydrogenation distillate as a product.

2. The process of claim 1 defined further to include the step of:

recycling at least a portion of said light phase residuum as said liquefaction solvent used in contacting said carbonaceous solid.

3. The process of claim 2 wherein said recycled light phase residuum comprises from 5 to 100 weight percent of said liquefaction solvent.

4. The process of claim 2 wherein said recycled light phase residuum comprises from 5 to 30 weight percent of said liquefaction solvent.

5. The process of claim 1 wherein treating said residuum to separate unconverted coal and mineral matter and fractionating the solids-free residuum is defined further as:

contacting said residuum with a deashing solvent in a first separation vessel maintained at a temperature in the range of from about 400° F. to about 700° F. and a pressure above about 550 psig.;

separating said residuum-deashing solvent mixture into a first light phase comprising substantially solids-free residuum and deashing solvent and a first heavy phase comprising unconverted coal, mineral matter and some deashing solvent;

introducing said first light phase into a second separation vessel maintained at a temperature above the temperature in the first separation vessel and a pressure substantially the same as in the first separation vessel; and separating said first light phase into a second light phase comprising light phase residuum and deashing solvent and a second heavy phase comprising heavy phase residuum and some deashing solvent.

6. The process of claim 5 wherein the temperature in the second separation vessel is maintained in the range of from about 450° F. to about 900° F.

7. The process of claim 5 wherein the pressure level in the second separation vessel is maintained in the range of from about 400 to 1500 psig.

8. The process of claim 5 wherein the pressure level in the first separation vessel is in the range of from about 550 to about 1500 psig.

9. The process of claim 1 wherein a catalyst is present in the liquefaction zone.

10. The process of claim 9 wherein treating said residuum to form a substantially solids-free residuum includes the separation of at least a portion of the catalyst together with the other separated solids.

11. A process comprising:

contacting a carbonaceous solid with a liquefaction solvent in the substantial absence of gaseous hydrogen under liquefaction conditions in a liquefaction zone to produce a liquefaction effluent comprising liquid products;

admixing said liquefaction liquid products with a process derived hydrogenation residuum having a nominal boiling temperature above about 1000° F. to form a mixture;

separating distillables from said mixture to leave a liquefaction residuum, said distillables having a boiling temperature below about 1000° F.;

admixing said liquefaction residuum with a deashing solvent to form a prepared mixture;

separating said prepared mixture in a first separation vessel maintained at a temperature in the range of from about 400° F. to about 700° F. and a pressure above about 550 psig. into a first light phase and a first heavy phase;

introducing said first light phase into a second separation vessel maintained at a temperature level above the temperature level in the first separation vessel and a pressure substantially the same as in the first separation vessel;

separating said first light phase in said second separation vessel into a second light phase comprising light phase residuum and deashing solvent and a second heavy phase comprising heavy phase residuum;

admixing said heavy phase residuum with a process derived hydrogenation distillate to form a second mixture, said hydrogenation distillate having a boiling temperature below about 1000° F.;

hydrogenating said second mixture in a hydrogenation zone to convert at least a portion of said heavy phase residuum in said second mixture into a hydrogenation distillate having a boiling a boiling temperature below about 1000° F. and leave a hydrogenation residuum;

recycling at least a portion of said hydrogenation distillate as said process derived hydrogenation distillate;

recycling at least a portion of said hydrogenation residuum as said process derived hydrogenation residuum; and recovering any remaining hydrogenation distillate as a product.

12. The process of claim 11 wherein at least a portion of said light phase residuum is recycled for use as at least a portion of the liquefaction solvent.

13. The process of claim 11 wherein an additional quantity of deashing solvent is admixed with the first light phase before separation into the second light phase and second heavy phase in the second separation vessel.

14. The process of claim 11 wherein the liquefaction conditions include a temperature in the range of from about 700° F. to about 900° F. and a pressure in the range of from about 500 to about 5000 psig.

15. The process of claim 11 wherein said light phase residuum is recycled as a portion of said liquefaction solvent and comprises from 5 to 100 weight percent of said liquefaction solvent.

16. The process of claim 11 wherein said light phase residuum is recycled as a portion of said liquefaction solvent and comprises from 5 to 30 weight percent of said liquefaction solvent.

17. The process of claim 11 wherein said hydrogenation of said heavy phase residuum is effected catalytically.

18. The process of claim 11 wherein the first separation vessel is maintained at a pressure in the range of from about 550 psig. to about 1500 psig.

19. The process of claim 11 wherein the second separation vessel is maintained at a temperature in the range of from about 450° F. to about 900° F.

20. The process of claim 11 wherein the second separation vessel is maintained at a pressure in the range of from about 400 psig. to about 1500 psig.

21. The process of claim 11 wherein a catalyst is present in the liquefaction zone.

* * * * *